US010533375B2

(12) United States Patent
Robello

(10) Patent No.: US 10,533,375 B2
(45) Date of Patent: Jan. 14, 2020

(54) MULTIPLE SPEED DRILL BIT ASSEMBLY

(71) Applicant: Halliburton Energy Services, Inc., Houston, TX (US)

(72) Inventor: Samuel Robello, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 123 days.

(21) Appl. No.: 15/577,047

(22) PCT Filed: Jul. 24, 2015

(86) PCT No.: PCT/US2015/041983
§ 371 (c)(1),
(2) Date: Nov. 27, 2017

(87) PCT Pub. No.: WO2017/018990
PCT Pub. Date: Feb. 2, 2017

(65) Prior Publication Data
US 2018/0135354 A1 May 17, 2018

(51) Int. Cl.

| | |
|---|---|
| ***E21B 4/02*** | (2006.01) |
| ***E21B 10/26*** | (2006.01) |
| ***E21B 17/22*** | (2006.01) |
| *E21B 3/00* | (2006.01) |
| *E21B 7/04* | (2006.01) |

(52) U.S. Cl.
CPC ..... *E21B 4/02* (2013.01); *E21B 10/26* (2013.01); *E21B 17/22* (2013.01); *E21B 3/00* (2013.01); *E21B 7/04* (2013.01)

(58) Field of Classification Search
CPC ..... E21B 4/02; E21B 10/26
See application file for complete search history.

(56) References Cited

U.S. PATENT DOCUMENTS

| | | | |
|---|---|---|---|
| 3,840,080 | A | 10/1974 | Berryman |
| 3,951,220 | A | 4/1976 | Phillips et al. |
| 4,775,017 | A | 10/1988 | Forrest et al. |
| 5,205,682 | A | 4/1993 | Jinkins et al. |

(Continued)

FOREIGN PATENT DOCUMENTS

| | | |
|---|---|---|
| CA | 1298103 | 3/1992 |
| CA | 2237785 | 11/1999 |

(Continued)

OTHER PUBLICATIONS

International Patent Application No. PCT/US2015/041983 , "International Search Report and Written Opinion", dated Mar. 31, 2016, 14 pages.

*Primary Examiner* — Giovanna C Wright
(74) *Attorney, Agent, or Firm* — Kilpatrick Townsend & Stockton LLP

(57) ABSTRACT

A drill bit may include rings that are rotatable at different speeds along a single axis. The drill bit may be coupled to a motor using multiple driveshafts. Each driveshaft can be coupled to one of the rings. Each driveshaft may transmit a different amount of torque from the motor to the rings to allow each ring to rotate at a different speed. In some aspects, the driveshafts may include a center driveshaft coupled to a pilot ring of the drill bit and an outer driveshaft coupled to an outer ring of the drill bit. The drill bit may include additional rings coupled to the motor by additional driveshafts.

21 Claims, 9 Drawing Sheets

(56) References Cited

U.S. PATENT DOCUMENTS

| | | | | |
|---|---|---|---|---|
| 5,518,379 | A | 5/1996 | Harris et al. | |
| 5,845,721 | A * | 12/1998 | Southard | E21B 4/006 175/57 |
| 7,111,694 | B2 | 9/2006 | Beaton | |
| 7,562,725 | B1 * | 7/2009 | Broussard | E21B 7/28 175/107 |
| 8,191,635 | B2 | 6/2012 | Buske et al. | |
| 2009/0321136 | A1 * | 12/2009 | Southard | E21B 4/006 175/57 |
| 2010/0038141 | A1 | 2/2010 | Johnson et al. | |
| 2013/0247475 | A1 | 9/2013 | Lind et al. | |
| 2014/0131107 | A1 * | 5/2014 | Southard | E21B 4/006 175/57 |

FOREIGN PATENT DOCUMENTS

| | | |
|---|---|---|
| CA | 2342615 | 5/2007 |
| CA | 2776575 | 4/2011 |
| CN | 203050520 | 7/2013 |
| CN | 203124775 | 8/2013 |
| EP | 251984 | 1/1988 |
| EP | 415519 | 3/1991 |
| EP | 1117896 | 6/2003 |
| WO | 2013070479 | 5/2013 |

* cited by examiner

MULTIPLE SPEED DRILL BIT ASSEMBLY

TECHNICAL FIELD

The present disclosure relates generally to a drill bit assembly for a drilling system and, more particularly (although not necessarily exclusively), to a multiple speed drill bit assembly.

BACKGROUND

A rotary steerable system may be included in a drilling system for directional drilling. From the surface of a wellbore, the rotary steerable system may be used to steer a drill string of a drilling assembly in a desired direction as the drill string continuously rotates in the wellbore. The methods for steering the drill string may be described as point-the-bit or push-the-bit. Point-the-bit rotary steerable systems allow a drill bit to tilt to a desired direction using a deflection mechanism to bend a shaft coupled to the drill bit. Push-the-bit rotary steerable systems allow the drill bit to be forced to the desired direction using pads on the outside of the drill bit to push against a wall of the wellbore. The drill bit may change directions as it pushes against the wellbore wall. Some rotary steerable systems are hybrid systems that use both the point-the-bit and push-the-bit methods for steering the drill string.

DETAILED DESCRIPTION

Certain aspects and examples of the present disclosure relate to a drill bit having rings that are rotatable at different speeds and torque levels. The drill bit may be coupled to a motor using multiple driveshafts. Each driveshaft may be coupled to one of the rings of the drill bit to allow each ring to rotate at a different speed from the other rings. In some aspects, a center driveshaft may be coupled to a pilot ring of the drill bit and an outer driveshaft may be coupled to an outer ring of the drill bit. In additional and alternative aspects, the rings may include a pilot ring to bore a pilot hole in a wellbore and one or more hole-opener rings that can enlarge the pilot hole.

Rotary steerable systems may allow an increased amount of weight on bit ("WOB"). By rotating the drill string, the axial drag of the drill as the drilling system bores through the wellbore may be reduced to allow a larger amount of WOB to be available at the drill bit. The rotation of the drill string may also prevent common hazards to the drilling tools by improving cleaning of the borehole and reducing the risk of differential sticking as the drill bit presses against the surfaces of borehole.

Existing rotary steerable system tools may be supplemented with a downhole hydraulic motor operating in tandem with the system to provide additional power to the drill bit. This combination may deliver an increased amount of horsepower and revolutions per minute directly to the drill bit. This combination may also overcome challenging formations while reducing the occurrence of stick-slip. The ability of an operator to adjust the configuration of the downhole motor, hydraulically or through radio frequency identification, may cause the drill bit to rotate simultaneously at multiple speeds, enhancing the drilling capabilities of a rotary steerable system.

Figure 1:
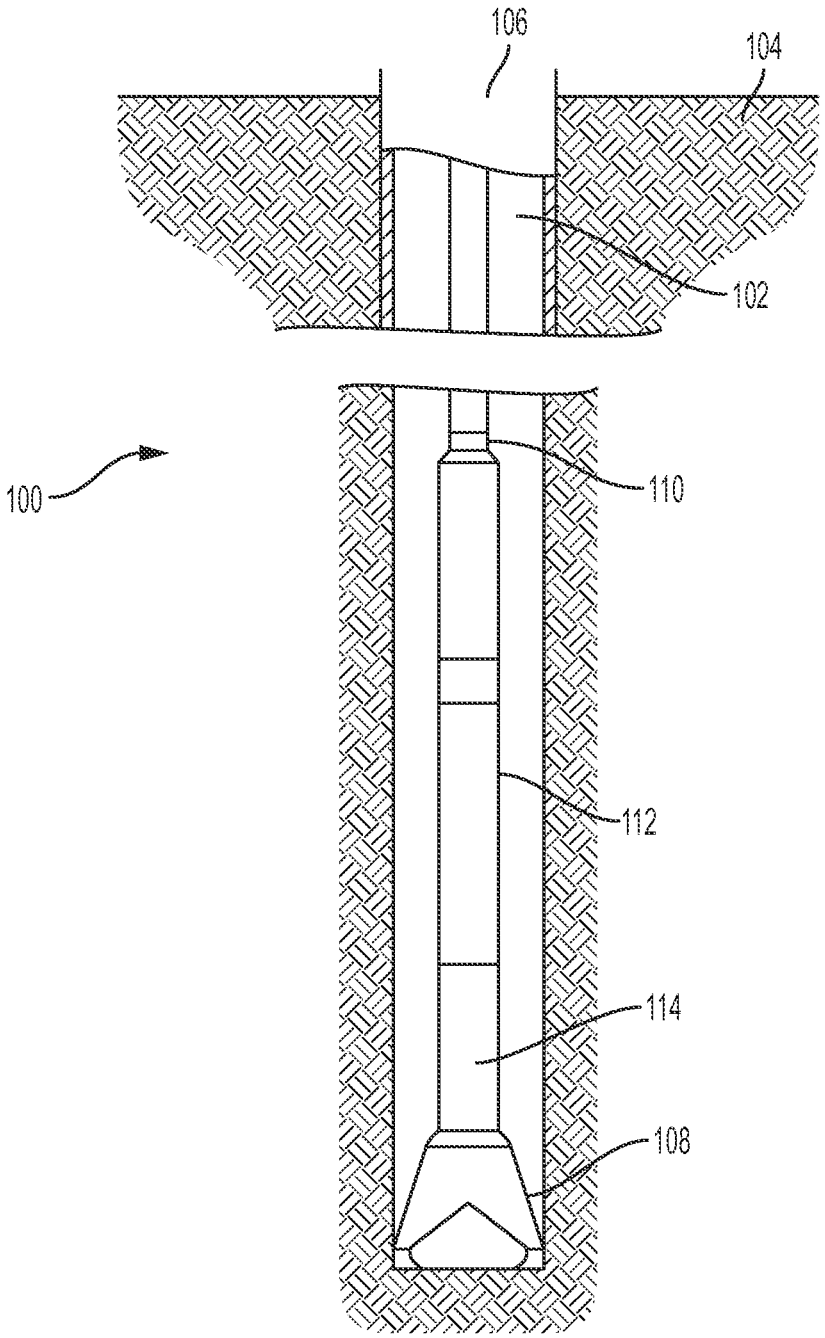
FIG. 1 is a cross-sectional schematic diagram depicting an example of a drilling system that may include a drill bit assembly according to one aspect of the present disclosure.

Various aspects of the present disclosure may be implemented in various drilling systems. FIG. 1 illustrates an example of such a drilling system 100 that includes a drill string 102. The drill string 102 of a drilling rig (not shown) may include segmented pipes that may extend below the surface 104 in a borehole, such as a wellbore 106. The drill string 102 may transmit drilling fluid (or mud) necessary to operate a drill bit 108. The weight of the drill string 102 may provide an axial force on the drill bit 108. Although FIG. 1 shows the drill bit oriented in a downward direction, the drill bit may be oriented in any direction in the wellbore 106 without departing from the scope of the present subject matter.

The drill string 102 may include a drill pipe 110 and a bottom hole assembly 112. The bottom hole assembly 112 may include various components, such as a downhole motor assembly 114 and the drill bit 108. Though placement of certain examples of the assemblies disclosed herein may vary without departing from the scope of the present subject matter, the assemblies of the present disclosure may be included in the downhole motor assembly 114 and the drill bit 108. For example, the downhole motor assembly 114 may include a drill bit assembly having a downhole mud motor and one or more driveshafts coupled to the drill bit 108.

Figure 2:
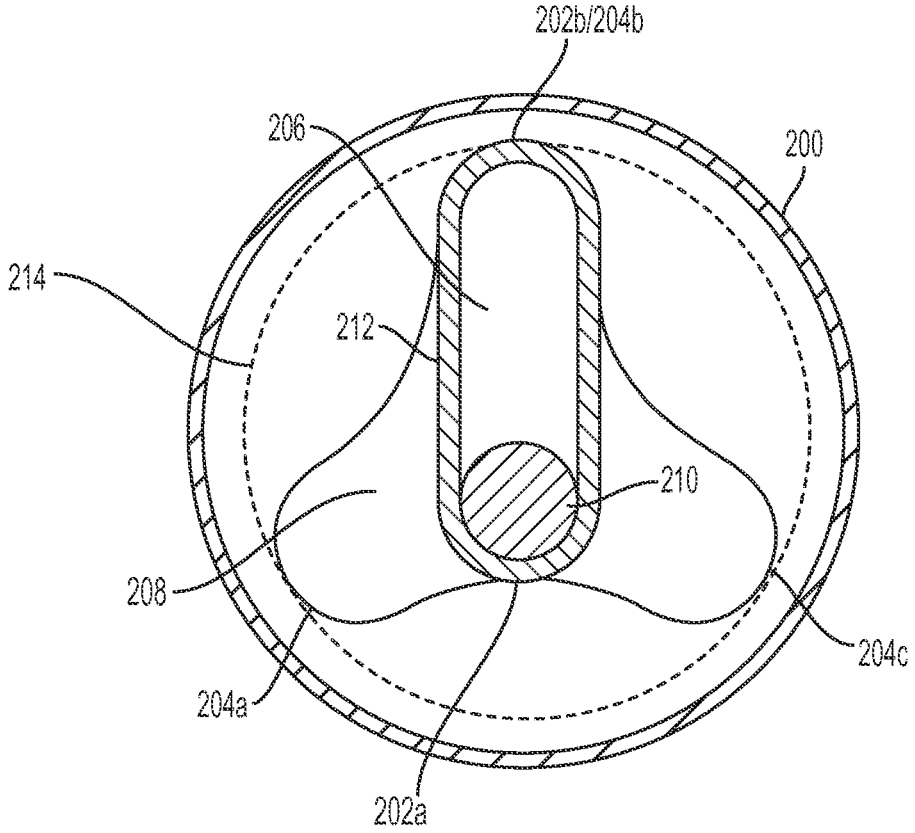
FIG. 2 is a cross-sectional view of a drill bit assembly according to one aspect of the present disclosure.

FIG. 2 shows an example of a drill bit assembly that may be included in the downhole motor assembly 114 of the drilling system 100 of FIG. 1. The drill bit assembly may include a motor 200. In some aspects, the motor 200 may be a mud motor for providing power to a drill bit (e.g., the drill bit 108 of FIG. 1). Driveshafts may be positioned between the motor 200 and the drill bit to couple a power section of the motor 200 to the drill bit. The motor 200 may be configured in various ways apply torque to the drill bit through the driveshafts. For example, the motor 200 may include a two-lobe configuration and a three-lobe configuration. The two-lobe configuration is represented by the lobes 202*a*, 202*b* in the power section of the motor 200. The three-lobe configuration is represented by lobes 204*a*, 204*b*, 204*c* in the power section of the motor 200. In some aspects, the lobes 202*a*, 202*b* of the two-lobe configuration and the lobes 204*a*, 204*b*, 204*c* of the three-lobe configuration may represent positions on the power section of the motor 200 corresponding to lobes on the driveshafts coupled to the motor 200. In other aspects, the lobes 202*a*, 202*b* of the two-lobe configuration and the lobes 204*a*, 204*b*, 204*c* of the three-lobe configuration may represent grooves, edges, ridges or other indentations in the motor 200 for positioning or coupling driveshafts to the motor 200.

The two-lobe configuration includes a cavity 206 between the two lobes 202*a*, 202*b*. The three-lobe configuration includes a gap 208 between the three lobes 204*a*, 204*b*, 204*c*. The cavity 206 and the gap 208 may each be openings or other passages in the power section of the motor 200 for allowing drilling fluid to pass through. In some aspects, the cavity 206 and the gap 208 may be configured in an open state or a closed state to cause the motor 200 to operate in the two-lobe configuration or the three-lobe configuration. For example, when the cavity 206 between the two lobes 202*a*, 202*b* is in a closed state and the gap 208 between the three lobes 204*a*, 204*b*, 204*c* is in an open state, the motor 200 may operate in the three-lobe configuration. When the gap 208 is in a closed state and the cavity 206 is in an open state, the motor 200 may operate in the two-lobe configuration. The state of the cavity 206 and gap 208 may control the flow of drilling fluid through the cavity 206 and the gap 208 and into or around driveshafts coupled to the motor 200. In some aspects, the motor 200 may be coupled to a mechanism for controlling the states of the cavity 206 or gap 208.

A center driveshaft 210 may be coupled to the motor 200 and positioned in the cavity 206. An outer driveshaft 212 may be coupled to the motor 200 and positioned in the gap 208. A housing 214 may also be coupled to the motor 200 and positioned to house the center driveshaft 210 and the outer driveshaft 212. In some aspects, the center driveshaft 210 may include a circular cross-section as shown in FIG. 2. In other aspects, the cross-section of the center driveshaft 210 may include any shape for allowing the center driveshaft 210 to rotate in the cavity. The outer driveshaft 212 may include lobes corresponding to the two lobes 202*a*, 202*b* and may be coupled to the motor 200 at the two lobes 202, 202*b*. The housing 214 may include lobes corresponding to the three lobes 204*a*, 204*b*, 204*c*.

The cavity 206 may be opened to allow drilling fluid to flow around the center driveshaft 210 when the motor 200 is operating in the two-lobe configuration (e.g., when the gap 208 is closed). As the drilling fluid flows around the center driveshaft 210, the center driveshaft 210 may rotate to cause a portion of the drill bit 108 that is coupled to the center driveshaft 210 to rotate. In some aspects, the outer driveshaft 212 may not rotate when the motor 200 is operating in the two-lobe configuration. In response to the lack of rotation of the outer driveshaft 212, a portion of the drill bit 108 coupled to the outer driveshaft 212 may not rotate. The gap 208 may be opened to allow drilling fluid to flow around the outer driveshaft 212 when the motor 200 is operating in the three-lobe configuration (e.g., when the cavity 206 is closed). As the drilling fluid flows around the outer driveshaft 212, the outer driveshaft 212 may rotate, causing the portion of the drill bit coupled to the outer driveshaft 212 to rotate. In some aspects, the operation of the motor 200 in the three-lobe configuration may also cause the center driveshaft 210 to rotate.

Figure 3:
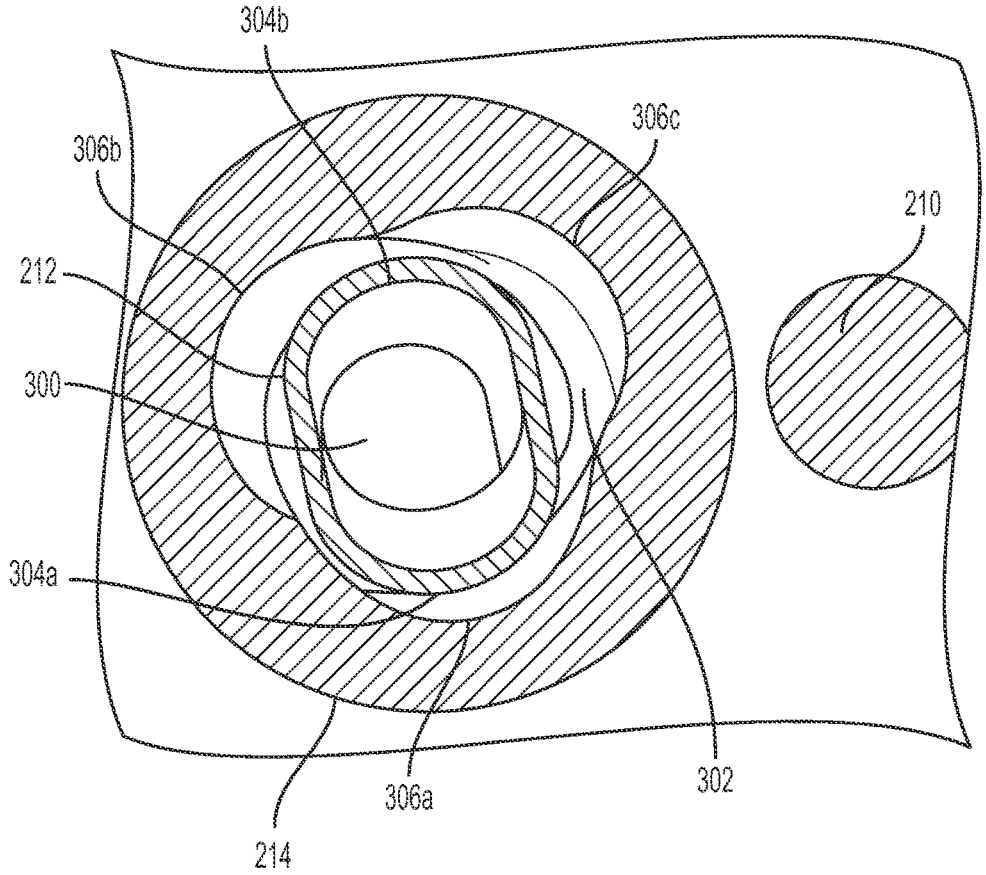
FIG. 3 is a cross-sectional view of disassembled driveshafts for the drill bit assembly of FIG. 2 according to one aspect of the present disclosure.

FIG. 3 shows a cross-sectional view of the center driveshaft 210 and the outer driveshaft 212. The center driveshaft 210 is shown in FIG. 2 as disassembled from the motor 200 shown in FIG. 2. The outer driveshaft 212 includes a hollow center 300 extending the length of the outer driveshaft 212. The hollow center 300 may correspond to the cavity 206 of the motor 200 and may allow drilling fluid to pass through the outer driveshaft 212 when the cavity 206 of the motor 200 is open (e.g., when the motor 200 is operating in the two-lobe configuration). The center driveshaft 210 may be positioned in the hollow center 300 when the center driveshaft 210 is coupled to the motor 200. The housing 214 includes a hollow center 302 that may correspond to the gap 208 of the motor 200. The hollow center 302 may allow drilling fluid to pass through the housing 214 when the gap 208 of the motor 200 is open (e.g., when the motor 200 is operating in the three-lobe configuration). The outer driveshaft 212 may be positioned in the hollow center 302 of the housing 214 as shown in FIG. 3.

The outer driveshaft 212 includes two lobes 304*a*, 304*b* corresponding to lobes 202*a*, 202*b* of the motor 200 of FIG. 2. The housing 214 includes three lobes 306*a*, 306*b*, 306*c* corresponding to lobes 204*a*, 204*b*, 204*c* of the motor 200 of FIG. 2. The outer driveshaft 212 may oscillate between the three lobes 306*a*, 306*b*, 306*c* of the housing 214 as the outer driveshaft 212 rotates in the hollow center 302 when the motor 200 is operating in the three-lobe configuration. The center driveshaft 210 may oscillate between the two lobes 304*a*, 304*b* as the center driveshaft 210 rotates in the hollow center 300 of the outer driveshaft 212 when the motor 200 is operating in the two-lobe configuration. In some aspects, the center driveshaft 210 may have limited or no rotation when the motor 200 is operating in the three-lobe configuration. But, the rotation of the outer driveshaft 212 may cause the center driveshaft 210 to oscillate between the lobes 304*a*, 304*b* to cause the portion of the drill bit 108 coupled to the center driveshaft 210 to rotate.

Although the motor 200 is discussed only with respect to a two-lobe configuration and a three-lobe configuration, the motor 200 may include additional configurations including more than three lobes and may be coupled to additional driveshafts having more than two lobes. For example, the motor 200 may be configured to operate in a four-lobe configuration. In the four-lobe configuration, the housing 214 may be replaced by an additional driveshaft having three lobes. A larger housing having four lobes may be positioned external to the additional driveshaft. The additional driveshaft may rotate and oscillate between the four lobes of the larger housing in a similar manner to the oscillation of the outer driveshaft 212 described herein. In some aspects, the assembly may be further expanded to include additional driveshafts and larger housings (e.g., a five-lobe housing for a four-lobe driveshaft, a six-lobe housing for a five-lobe driveshaft, a ten-lobe housing for a nine-lobe driveshaft, etc.). In additional and alternative aspects, the motor 200 may be operable in such configurations with or without a driveshaft positioned in a hollow center of each driveshaft in the configuration that includes a hollow center (e.g., a driveshaft internal to another driveshaft except for the center driveshaft 210, which does not include a hollow center). For example, the motor 200 may be operable in the four-lobe configuration with or without the center driveshaft 210 being included in the hollow center 300 of the outer driveshaft 212.

Figure 4:
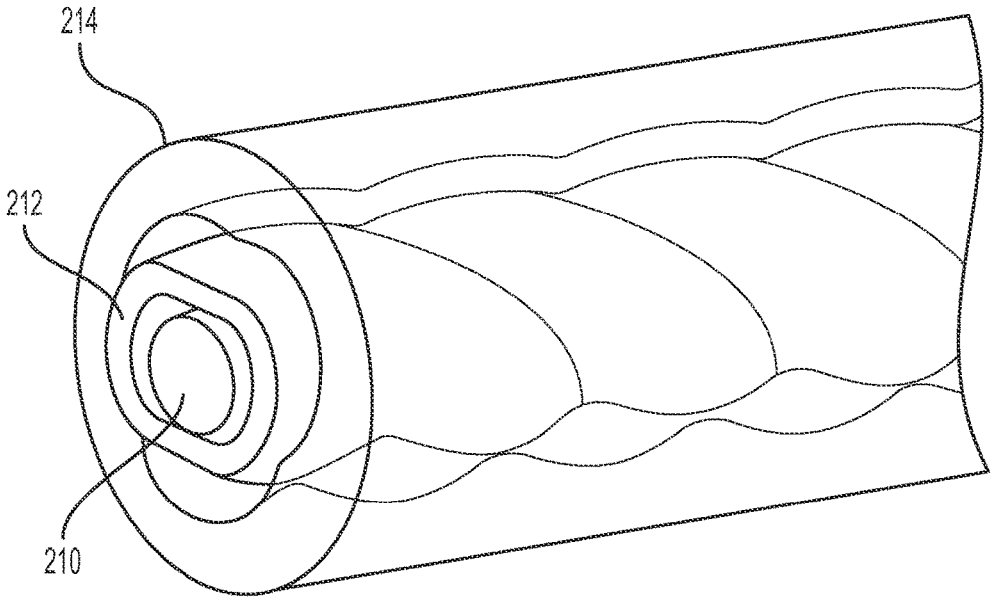
FIG. 4 is a perspective view of assembled driveshafts for a drill bit assembly of FIG. 2 according to one aspect of the present disclosure.
Figure 5:
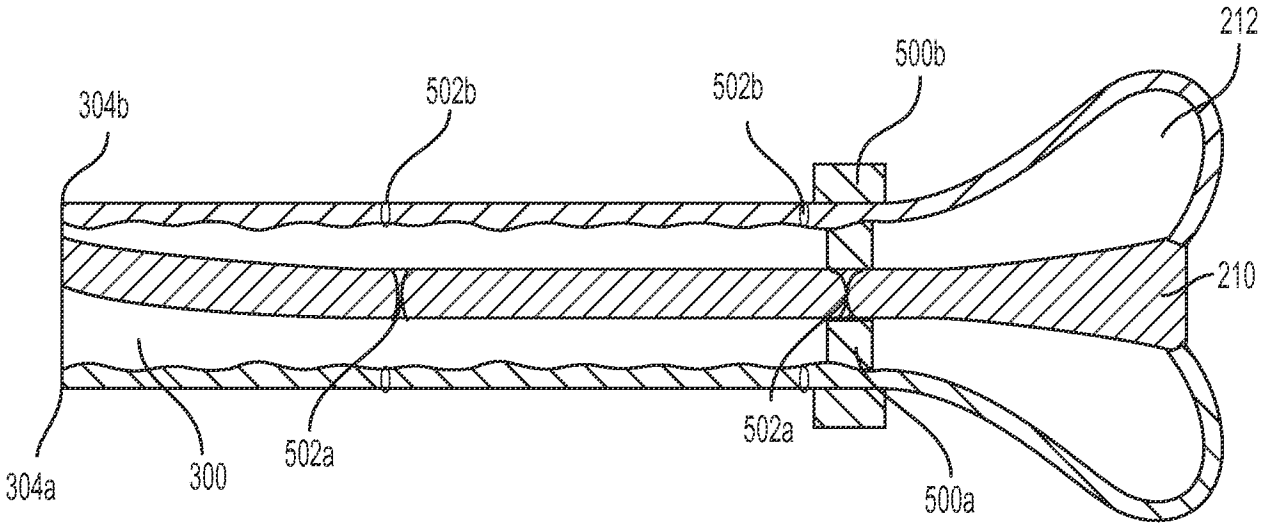
FIG. 5 is a cross-sectional view of a drill bit assembly of FIG. 2 according to one aspect of the present disclosure.

FIGS. 4 and 5 show the center driveshaft 210 positioned in the hollow center 300 of the outer driveshaft 212. FIG. 4 shows a transparent, perspective view of the center driveshaft 210, the outer driveshaft 212, and the housing 214. FIG. 5 shows a side view of the center driveshaft 210 and the outer driveshaft 212. The center driveshaft 210 and the outer driveshaft 212 may each include one or more bearings 500*a*, 500*b*. The bearings 500*a* may be positioned on the center driveshaft 210 to allow the center driveshaft 210 and the outer driveshaft 212 to rotate smoothly and to support an axial load. The axial load may be applied by the portion of the drill bit 108 coupled to the center driveshaft 210. The bearings 500*b* may be positioned on the outer driveshaft 212 to support an axial load applied on the outer driveshaft 212 by the portion of the drill bit 108 coupled to the outer driveshaft 212. As the drilling assembly operates in a wellbore 106, the drill bit 108 may contact a surface of the wellbore 106. The contact between the surface of the wellbore 106 and the drill bit 108 may generate an axial load on the drill bit 108 that traverses the driveshafts coupled to the drill bit 108. The bearings 500*a*, 500*b* may support the axial load to prevent or reduce the axial load applied to the motor 200. In this manner, the bearings 500*a*, 500*b* may prevent potential damage to the motor 200 or another component of the drilling system 100 caused by an axial load from the drill bit 108.

The center driveshaft 210 and the outer driveshaft 212 may also include one or more universal joints 502*a*, 502*b* to allow the center driveshaft 210 and the outer driveshaft 212 to bend. The ability of the center driveshaft 210 and the outer driveshaft 212 to bend may be of particular importance when the drilling system 100 is used for directional drilling. Further, the universal joints 502*a*, 502*b* may allow the center driveshaft 210 and the outer driveshaft 212 the flexibility to rotate and oscillate in response to the configuration of the motor. For example, the center driveshaft 210 may bend as shown in FIG. 5 as it oscillates between the lobes 304*a*, 304*b* of the outer driveshaft 212. In some aspects, the center driveshaft 210 or the outer driveshaft 212 may be flexible driveshafts that allow the driveshafts to bend without the use of universal joints 502*a*, 502*b*.

Figure 6:
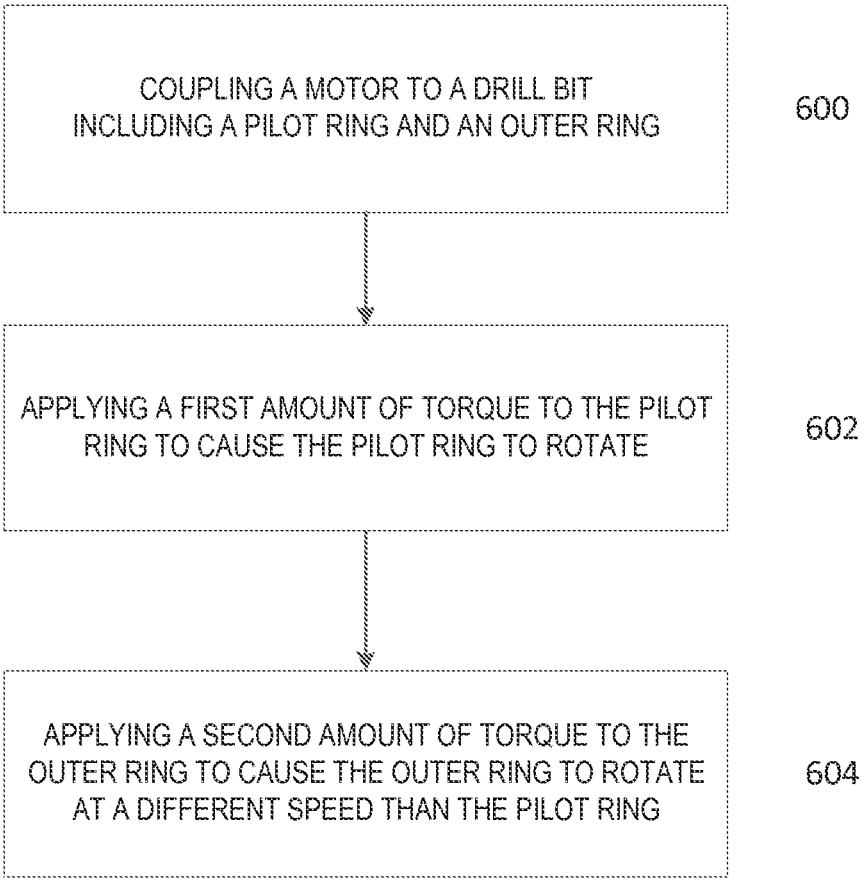
FIG. 6 is a flow diagram of a process for drilling using the drill bit assembly according to one aspect of the present disclosure.

FIG. 6 is a flowchart showing a process for drilling using the drilling system 100 of FIG. 1 according to one example.

Figure 7:
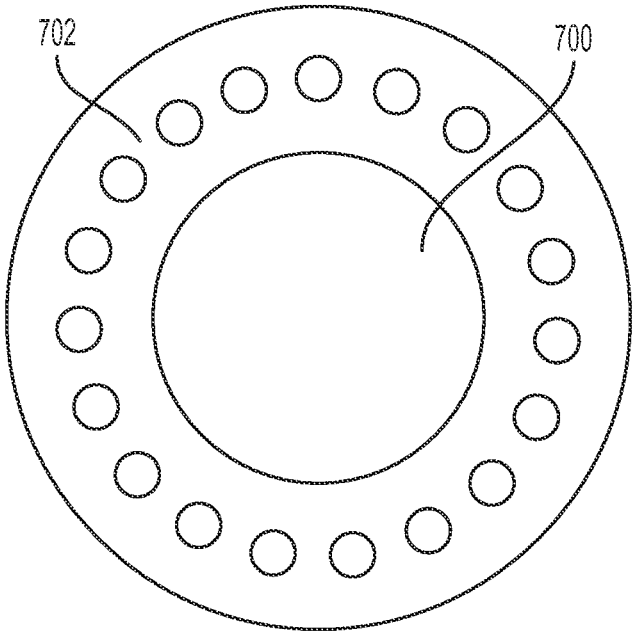
FIG. 7 is a cross-sectional view of a drill bit according to one aspect of the present disclosure.

In block 600, the motor 200 is coupled to the drill bit 108. The drill bit 108 may include multiple rings, including a pilot ring 700 and an outer ring 702, as shown in FIG. 7. The motor 200 may be coupled to the pilot ring 700 through the center driveshaft 210 and to the outer ring 702 through the outer driveshaft 212. The pilot ring 700 and the outer ring 702 may be sub-components of the drill bit 108 that rotate independently from each other and any other rings included in the drill bit 108.

In block 602, the motor 200 applies torque to the pilot ring to cause the pilot ring 700 to rotate. The torque may be applied from the motor 200 through the center driveshaft 210 to the pilot ring. In some aspects, the torque may cause the center driveshaft 210 to rotate, causing the pilot ring to rotate. In other aspects, the torque may be directly applied to another driveshaft (e.g., the outer driveshaft 212) and a portion of the torque may be transferred to the center driveshaft based on the rotation of the other driveshaft. For example, the positioning of the center driveshaft 210 in the hollow center 300 of the outer driveshaft 212 may cause the center driveshaft 210 to oscillate between the lobes 304*a*, 304*b* of the outer driveshaft 212, causing the pilot ring 700 to rotate. In this manner, the torque applied to the pilot ring may be dependent on the operating configuration of the motor 200.

In block 604, the motor 200 applies torque to the outer ring to cause the outer ring to rotate at a different speed than the rotational speed of the pilot ring. The amount of torque applied to the outer ring may be greater than the amount of torque applied to the pilot ring. In some aspects, the variance in torque may be a factor of the diameters of the outer ring 702 and the pilot ring 700, the diameters of the driveshafts coupled to the outer ring 702 and the pilot ring 700, the total amount of torque applied by the motor 200, or the operational configuration of the motor 200.

Although a lesser amount of torque may be applied to the pilot ring 700, the rotational speed of the pilot ring 700 may be greater than the rotational speed of the outer ring 702. In some aspects, when the motor 200 is operating in a 3-lobe configuration, the speed of the outer ring may be two-thirds the speed of the inner ring. In some aspects, a drill bit may include additional rings coupled to additional driveshafts. For a drill bit having x number of rings, the motor 200 coupled to the drill bit may be configured to operate in a z-lobe configuration, where z=x+1 and where z also represents the number of lobes that may be included on the housing external to the outermost driveshaft coupled to the motor 200. Each ring of the drill bit may rotate at a speed that is a fraction $$\frac{n}{n+1}$$

of the innermost ring (e.g, the pilot ring 700), where n represents the ring number from the innermost ring. For example, in FIG. 7, the outer ring 702 is the second ring from the innermost ring. Thus, the speed of the outer ring 702 may be $$\frac{2}{3}$$

the speed of the pilot ring 700 (e.g., n=2). The speed of each ring in the drill bit may be compounded to determine an overall speed of the drill bit.

Figure 8:
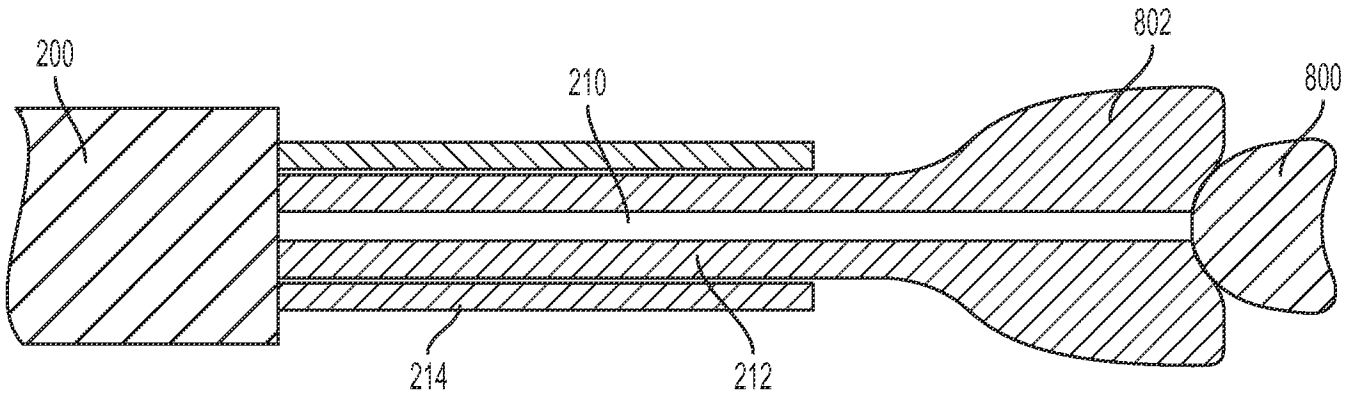
FIG. 8 is a perspective view of a drill bit assembly including a hole opener according to one aspect of the present disclosure.

In some aspects, one or more of the rings of the drill bit may include a pilot ring and at least one hole-opener ring. For example, FIG. 8 shows the motor 200 coupled to a drill bit including a pilot ring 800 and a hole-opener ring 802. The pilot ring may be coupled to the motor 200 by the center driveshaft 210 and the hole-opener ring may be coupled to the motor 200 by the outer driveshaft 212. The pilot ring 800 may include a bit head having cutters on a surface of the pilot ring 800 for boring a pilot hole into a surface of the wellbore 106. The hole-opener ring may include a bit head shaped or having cutters for expanding the pilot hole.

Figure 9:
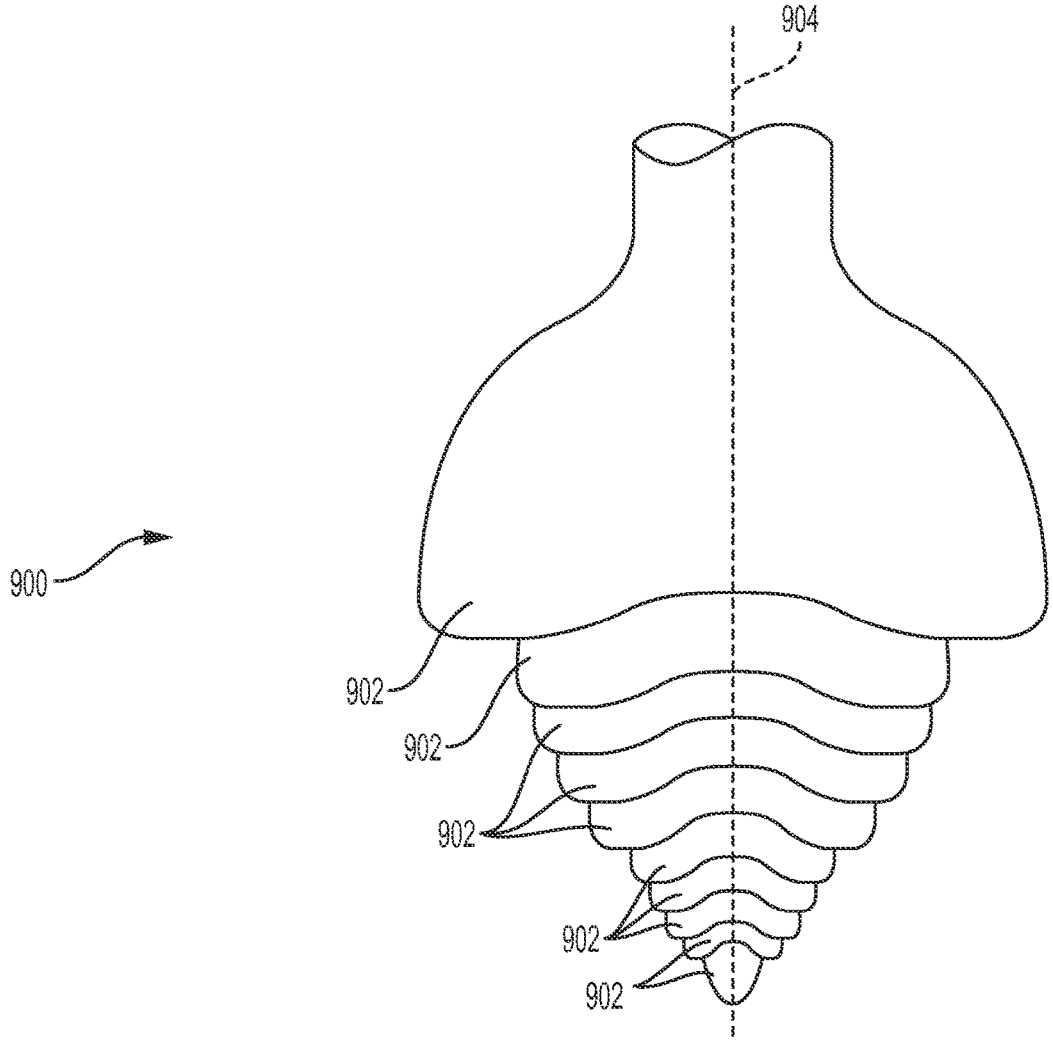
FIG. 9 is a perspective view of a drill bit including rings according to one aspect of the present disclosure.

Although the drill bit shown in FIG. 8 includes only two rings, the drill bit may include additional rings without departing from the scope of the present disclosure. For example, FIG. 9 shows a drill bit 900 having rings 902 that include more than two rings as shown in FIG. 8. The rings 902 may be aligned to allow the drill bit 900 to rotate along a single axis (indicated in FIG. 9 by a dotted line 904). The rotation of the drill bit 900 along the axis may allow the WOB available at the drill bit 900 to be concentrated on a drilling surface along the axis and allow for higher penetration rates and for more efficient drilling in the wellbore 106.

In some aspects, the drilling systems are provided according to one or more of the following examples:

Example #1

A drill bit assembly may include a drill bit rotatable along a single axis and having a plurality of rings. The drill bit assembly may also include a plurality of driveshafts corresponding to the plurality of rings of the drill bit. The drill bit assembly may also include a motor coupled to the plurality of driveshafts. The drill bit assembly may feature each driveshaft of the plurality of driveshafts being coupled to a corresponding ring of the plurality of rings. The drill bit assembly may also feature each ring of the plurality of rings being rotatable by the motor at a different speed than at least one other ring of the plurality of rings.

Example #2

The drill bit assembly of Example #1 may feature the plurality of driveshafts including a center driveshaft having a circular cross-section and an outer driveshaft having a cross-section including two lobes. The drill bit assembly may also feature the outer driveshaft being positioned internal to a housing having a cross-section including three lobes. The drill bit assembly may also feature the motor being operable in a first configuration in response to a closed gap and in a second configuration in response to a closed cavity. The drill bit assembly may also feature the first configuration including a first set of two lobes corresponding to the outer driveshaft and a cavity positioned between the first set of two lobes. The drilling assembly may also feature the second configuration including a second set of three lobes corresponding to the housing and a gap positioned between the second set of three lobes.

Example #3

The drill bit assembly of Examples #1-2 may feature the plurality of rings of the drill bit including a pilot ring and one or more outer rings. The drill bit assembly may also feature the pilot ring being coupled to the center driveshaft and is rotatable at a faster speed than the one or more outer rings.

Example #4

The drill bit assembly of Examples #1-3 may feature the center driveshaft being positioned to transmit a first amount of torque to the pilot ring. The drill bit assembly may also feature the outer driveshaft being coupled to an outermost ring of the one or more outer rings to transmit a second amount of torque to the outermost ring. The drill bit assembly may also feature the second amount of torque being greater than the first amount of torque.

Example #5

The drill bit assembly of Examples #1-4 may feature the plurality of driveshafts including a center driveshaft and one or more hollow driveshafts. The drill bit assembly may also feature each of the one or more hollow driveshafts including a hollow center. The drill bit assembly may also feature each of the one or more hollow driveshafts being positioned to receive the center driveshaft or another driveshaft of the one or more hollow driveshafts in the hollow center.

Example #6

The drill bit assembly of Examples #1-5 may feature the plurality of rings including a pilot ring for boring a pilot hole in a wellbore in response to a first amount of torque applied to the pilot ring. The drill bit assembly may also feature the plurality of rings including at least one hole-opener ring for enlarging the pilot hole in response to a second amount of torque applied to the at least one hole-opener ring. The drill bit assembly may feature the second amount of torque being greater than the first amount of torque.

Example #7

The drill bit assembly of Examples #1-6 may also include a plurality of bearings corresponding to the plurality of driveshafts. The drill bit assembly may feature each bearing being positioned on a corresponding driveshaft of the plurality of driveshafts to support an axial load applied on the corresponding driveshaft by the drill bit.

Example #8

The drill bit assembly of Examples #1-7 may further include a plurality of universal joints corresponding to the plurality of driveshafts. The drill bit assembly may feature each joint of the plurality of universal joints being positioned on a corresponding driveshaft of the plurality of driveshafts to allow the corresponding driveshaft to bend.

Example #9

A drilling system may include a drill bit rotatable along a single axis and having a plurality of rings rotatable at different speeds. The drilling system may also include a motor operable in a first configuration in response to a closed gap and a second configuration in response to a closed cavity. The drilling system may also include a center driveshaft and an outer driveshaft for coupling the drill bit to the motor. The drilling system may feature the first configuration having a first set of two lobes with a cavity positioned between the first set of two lobes. The drilling system may also feature the second configuration including a second set of three lobes with a gap positioned between the second set of three lobes.

Example #10

The drilling system of Example #9 may further include a housing. The drilling system may feature the center driveshaft including a circular cross-section and being positionable in the cavity. The drilling system may also feature the outer driveshaft including a cross-section corresponding to the first set of two lobes and being positionable internal to the housing. The drilling system may also feature the housing including a cross-section corresponding to the second set of three lobes and including a hollow center for receiving the outer driveshaft.

Example #11

The drilling system of Examples #9-10 may feature the motor being operable to switch between the first configuration and the second configuration to control a flow of drilling fluid in the cavity and the gap.

Example #12

The drilling system of Examples #9-11 may feature the plurality of rings of the drill bit including a pilot ring and one or more outer rings. The drilling system may also feature the pilot ring being rotatable at a faster speed than the one or more outer rings.

Example #13

The drilling system of Examples #9-12 may feature the pilot ring being positioned to bore a pilot hole in a wellbore.

The drilling system may also feature at least one of the one or more outer rings including a hole-opener ring operable to enlarge the pilot hole.

Example #14

The drilling system of Examples #9-13 may feature the plurality of rings of the drill bit including a pilot ring and an outer ring. The drilling system may also feature the pilot ring being coupled to the center driveshaft and rotatable at a faster speed than the outer ring in response to an amount of torque transmitted to the pilot ring by the center driveshaft. The drilling system may also feature the outer ring being coupled to the outer driveshaft and being positioned to receive a greater amount of torque than the amount of torque transmitted to the pilot ring.

Example #15

The drilling system of Examples #9-14 may also include one or more bearings positionable on the center driveshaft and the outer driveshaft for supporting an axial load applied on the center driveshaft and the outer driveshaft by the drill bit. The drilling system may also include one or more universal joints positionable on the center driveshaft and the outer driveshaft for allow the center driveshaft and the outer driveshaft to bend.

Example #16

A method for drilling may include coupling a motor to a drill bit using a center driveshaft and an outer driveshaft, the drill bit including a pilot ring and an outer ring. The method may also include applying a first amount of torque to the pilot ring of the drill bit through the center driveshaft to cause the pilot ring to rotate. The method may also include applying, via the motor, a second amount of torque to the outer ring of the drill bit through the outer driveshaft to cause the outer ring to rotate at a different speed than the pilot ring. The method may feature applying the first amount of torque to the pilot ring via the motor. The method may also feature applying the second amount of torque to the outer ring via the motor.

Example #17

The method of Example #16 may feature coupling the motor to the drill bit including positioning the center driveshaft in a cavity of the outer driveshaft having a first set of two lobes. The method may also feature coupling the motor to the drill bit including positioning the outer driveshaft in a gap of a housing having a second set of three or more lobes. The method may also feature coupling the motor to the drill bit including coupling the center driveshaft and the outer driveshaft to the drill bit to allow the drill bit to rotate along a single axis.

Example #18

The method of Examples #16-17 may also include boring a pilot hole into a wellbore using the pilot ring of the drill bit in response to the first amount of torque being applied to the pilot ring. The method may also include enlarging the pilot hole using the outer ring of the drill bit in response to the second amount of torque being applied to the outer ring.

Example #19

The method of Examples #16-18 may feature coupling the motor to the drill bit including positioning one or more bearings on the center driveshaft and the outer driveshaft to support an axial load applied on the center driveshaft and the outer driveshaft by the drill bit. The method may also feature coupling the motor to the drill bit including positioning one or more universal joints on the center driveshaft and the outer driveshaft for allow the center driveshaft and the outer driveshaft to bend.

Example #20

The method of Examples #16-19 may feature applying the second amount of torque causing the outer ring to rotate at a speed that is slower than a rotational speed of the pilot ring.

The foregoing description of the examples, including illustrated examples, has been presented only for the purpose of illustration and description and is not intended to be exhaustive or to limit the subject matter to the precise forms disclosed. Numerous modifications, combinations, adaptations, uses, and installations thereof can be apparent to those skilled in the art without departing from the scope of this disclosure. The illustrative examples described above are given to introduce the reader to the general subject matter discussed here and are not intended to limit the scope of the disclosed concepts.

What is claimed is:

1. A drill bit assembly comprising:

a drill bit rotatable along a single axis and having a plurality of rings;

a plurality of driveshafts corresponding to the plurality of rings of the drill bit, each driveshaft of the plurality of driveshafts being coupled to a corresponding ring of the plurality of rings;

a plurality of universal joints corresponding to the plurality of driveshafts, wherein each joint of the plurality of universal joints is positioned on a corresponding driveshaft of the plurality of driveshafts to allow the corresponding driveshaft to bend; and a motor coupled to the plurality of driveshafts, each ring of the plurality of rings being rotatable by the motor at a different speed than at least one other ring of the plurality of rings.

2. The drill bit assembly of claim 1, wherein the plurality of driveshafts includes a center driveshaft having a circular cross-section and an outer driveshaft having a cross-section including two lobes, wherein the outer driveshaft is positioned internal to a housing having a cross-section including three lobes, wherein the motor is operable in a first configuration in response to a closed gap and in a second configuration in response to a closed cavity, the first configuration including a first set of two lobes corresponding to the outer driveshaft and a cavity positioned between the first set of two lobes, the second configuration including a second set of three lobes corresponding to the housing and a gap positioned between the second set of three lobes.

3. The drill bit assembly of claim 2, wherein the plurality of rings of the drill bit includes a pilot ring and one or more outer rings, wherein the pilot ring is coupled to the center driveshaft and is rotatable at a faster speed than the one or more outer rings.

4. The drill bit assembly of claim 3, wherein the center driveshaft is positioned to transmit a first amount of torque to the pilot ring, wherein the outer driveshaft is coupled to an outermost ring of the one or more outer rings to transmit a second amount of torque to the outermost ring, wherein the second amount of torque is greater than the first amount of torque.

5. The drill bit assembly of claim 1, wherein the plurality of driveshafts includes a center driveshaft and one or more hollow driveshafts, wherein each of the one or more hollow driveshafts includes a hollow center, wherein each of the one or more hollow driveshafts is positioned to receive the center driveshaft or another driveshaft of the one or more hollow driveshafts in the hollow center.

6. The drill bit assembly of claim 1, wherein the plurality of rings includes:

a pilot ring for boring a pilot hole in a wellbore in response to a first amount of torque applied to the pilot ring; and at least one hole-opener ring for enlarging the pilot hole in response to a second amount of torque applied to the at least one hole-opener ring, wherein the second amount of torque is greater than the first amount of torque.

7. The drill bit assembly of claim 1, further including a plurality of bearings corresponding to the plurality of driveshafts, wherein each bearing is positioned on a corresponding driveshaft of the plurality of driveshafts to support an axial load applied on the corresponding driveshaft by the drill bit.

8. A drilling system comprising:

a drill bit rotatable along a single axis and having a plurality of rings rotatable at different speeds;

a motor operable in a first configuration in response to a closed gap and a second configuration in response to a closed cavity, the first configuration having a first set of two lobes with a cavity positioned between the first set of two lobes, the second configuration including a second set of three lobes with a gap positioned between the second set of three lobes; and a center driveshaft and an outer driveshaft for coupling the drill bit to the motor.

9. The drilling system of claim 8, further including a housing, wherein the center driveshaft includes a circular cross-section and is positionable in the cavity, wherein the outer driveshaft includes a cross-section corresponding to the first set of two lobes and is positionable internal to the housing, wherein the housing includes a cross-section corresponding to the second set of three lobes and includes a hollow center for receiving the outer driveshaft.

10. The drilling system of claim 8, wherein the motor is operable to switch between the first configuration and the second configuration to control a flow of drilling fluid in the cavity and the gap.

11. The drilling system of claim 8, wherein the plurality of rings of the drill bit includes a pilot ring and one or more outer rings, wherein the pilot ring is rotatable at a faster speed than the one or more outer rings.

12. The drilling system of claim 11, wherein the pilot ring is positioned to bore a pilot hole in a wellbore, wherein at least one of the one or more outer rings includes a hole-opener ring operable to enlarge the pilot hole.

13. The drilling system of claim 8, wherein the plurality of rings of the drill bit includes a pilot ring and an outer ring, wherein the pilot ring is coupled to the center driveshaft and rotatable at a faster speed than the outer ring in response to an amount of torque transmitted to the pilot ring by the center driveshaft, wherein the outer ring is coupled to the outer driveshaft and is positioned to receive a greater amount of torque than the amount of torque transmitted to the pilot ring.

14. The drilling system of claim 8, further including:

one or more bearings positionable on the center driveshaft and the outer driveshaft for supporting an axial load applied on the center driveshaft and the outer driveshaft by the drill bit; and one or more universal joints positionable on the center driveshaft and the outer driveshaft for allow the center driveshaft and the outer driveshaft to bend.

15. A method comprising:

positioning a center driveshaft in a cavity of an outer driveshaft having a first set of two lobes;

positioning the outer driveshaft in a gap of a housing having a second set of three or more lobes; and coupling a motor to a drill bit using the center driveshaft and the outer driveshaft to allow the drill bit to rotate along a single axis, the drill bit including a pilot ring and an outer ring.

16. The method of claim 15, further comprising:

boring a pilot hole into a wellbore using the pilot ring of the drill bit in response to a first amount of torque being applied to the pilot ring; and enlarging the pilot hole using the outer ring of the drill bit in response to a second amount of torque being applied to the outer ring.

17. The method of claim 15, wherein coupling the motor to the drill bit includes:

positioning one or more bearings on the center driveshaft and the outer driveshaft to support an axial load applied on the center driveshaft and the outer driveshaft by the drill bit; and positioning one or more universal joints on the center driveshaft and the outer driveshaft for allowing the center driveshaft and the outer driveshaft to bend.

18. A drill bit assembly comprising:

a drill bit having a plurality of rings, the drill bit being rotatable to drill a wellbore;

a first driveshaft coupled to a first ring among the plurality of rings;

a second driveshaft coupled to a second ring among the plurality of rings; and a motor coupled to the first driveshaft and the second driveshaft, wherein each ring of the plurality of rings is rotatable by the motor at a different speed than at least one other ring of the plurality of rings, and wherein the first driveshaft is operable independently of the second driveshaft.

19. The assembly of claim 18, wherein the first driveshaft is an inner driveshaft and the second driveshaft is an outer driveshaft.

20. The assembly of claim 19, wherein the inner driveshaft is positioned within the outer driveshaft.

21. The assembly of claim 18, wherein the drill bit is rotatable along a single axis.

* * * * *